US012116869B2

(12) United States Patent
Billington et al.

(10) Patent No.: US 12,116,869 B2
(45) Date of Patent: Oct. 15, 2024

(54) SUBSEA METHANE PRODUCTION ASSEMBLY

(71) Applicant: Aker Solutions AS, Lysaker (NO)

(72) Inventors: Anders Billington, Lommedalen (NO); Tatiana Gordeeva, Oslo (NO); Pavel Stefanov, Høvik (NO)

(73) Assignee: Aker Solutions AS, Lysaker (NO)

( * ) Notice: Subject to any disclaimer, the term of this patent is extended or adjusted under 35 U.S.C. 154(b) by 1623 days.

(21) Appl. No.: 16/313,641

(22) PCT Filed: Jul. 3, 2017

(86) PCT No.: PCT/NO2017/050176

§ 371 (c)(1),
(2) Date: Dec. 27, 2018

(87) PCT Pub. No.: WO2018/009073

PCT Pub. Date: Jan. 11, 2018

(65) Prior Publication Data

US 2019/0226303 A1 Jul. 25, 2019

(30) Foreign Application Priority Data

Jul. 6, 2016 (NO) ..... 20161125

(51) Int. Cl.
*E21B 43/013* (2006.01)
*E21B 41/00* (2006.01)
(Continued)

(52) U.S. Cl.
CPC ..... *E21B 43/013* (2013.01); *E21B 43/01* (2013.01); *E21B 43/36* (2013.01); *E21B 41/0099* (2020.05)

(58) Field of Classification Search
CPC ..... E21B 43/013; E21B 43/01; E21B 43/36; E21B 41/0099
See application file for complete search history.

(56) References Cited

U.S. PATENT DOCUMENTS 6,412,562 B1 * 7/2002 Shaw ..... F04D 13/086 166/105
7,686,086 B2 * 3/2010 Brammer ..... E21B 43/36 166/267
(Continued)

FOREIGN PATENT DOCUMENTS

CN 101555797 A 10/2009
CN 103867165 B 6/2014
(Continued)

OTHER PUBLICATIONS

Eriksson, Magnus, "International Search Report," prepared for PCT/NO2017/050176, as mailed Sep. 14, 2017, four pages.
(Continued)

*Primary Examiner* — Aaron L Lembo
(74) *Attorney, Agent, or Firm* — Bradley Arant Boult Cummings LLP

(57) ABSTRACT

A methane production assembly comprising a subsea well (3) extending from the seabed to a methane hydrate formation (5). The assembly comprises a well casing (7) extending into the subsea well (3), a subsea well control assembly (9), a submersible pump (17) in fluid communication with the methane hydrate formation, and a methane-water separator (29) having a water outlet (31) and a methane outlet (32). The submersible pump is arranged above the subsea well.

5 Claims, 5 Drawing Sheets

(51) Int. Cl.
*E21B 43/01* (2006.01)
*E21B 43/36* (2006.01)

(56) References Cited

U.S. PATENT DOCUMENTS

| | | | | |
|---|---|---|---|---|
| 8,127,841 | B2 * | 3/2012 | Onodera | E21B 43/08 166/250.03 |
| 9,874,065 | B2 * | 1/2018 | Christensen | E21B 43/128 |
| 2007/0163780 | A1 | 7/2007 | Onodera et al. | |

FOREIGN PATENT DOCUMENTS

| | | | | |
|---|---|---|---|---|
| CN | 105041271 | A | 11/2015 | |
| EP | 1518595 | A1 | 3/2005 | |
| JP | 3816535 | B2 | 8/2006 | |
| JP | 2009-520097 | A | 5/2009 | |
| JP | 2010-261252 | A | 11/2010 | |
| JP | 2015-030967 | A | 2/2015 | |
| JP | 2015-203282 | A | 11/2015 | |
| RU | 2402674 | C1 | 10/2010 | |
| WO | WO-2007072173 | A1 | 6/2007 | |
| WO | WO-2012061027 | A1 | 5/2012 | |
| WO | WO-2017111607 | A1 | 6/2017 | |
| WO | WO-2019134220 | A1 * | 7/2019 | E21B 43/01 |

OTHER PUBLICATIONS

Matsuzawa, Maki, et al., "A Completion System Application for the World's First Marine Hydrate Production Test," Offshore Technology Conference, May 5-8, 2014, pp. 1-22.

* cited by examiner

SUBSEA METHANE PRODUCTION ASSEMBLY

The present invention relates to production of methane from subsea methane hydrate reservoirs.

BACKGROUND

Vast amounts of naturally occurring methane hydrates, sometimes referred to as methane clathrate, exist. Typical areas of such formations are in the permafrost regions and below the seabed where there is a certain pressure. Within the oil and gas field, methane hydrate is a well-known substance, as it tends to form within hydrocarbon-conducting flow pipes, and thereby block the flow in such pipes.

Below a certain temperature and/or above a certain pressure, methane hydrate is a solid. By increasing temperature and/or by reducing pressure, it will dissolve into methane and water. Another way to dissolve it, is to inject inhibitors such as methanol, to shift the pressure-temperature equilibrium. International patent application publication WO2012061027 gives an introduction to this topic.

Being a possible energy resource for many countries, research has been performed to investigate how to produce methane from subsea formations. Methane is a significant greenhouse gas. Thus, the methane must be prevented from escaping into the atmosphere.

One known manner to produce methane from subsea formations, is to lower the pressure in the formation, thereby making the hydrate split into methane and water. To lower the pressure, it is known to provide a submersible pump, such as an ESP (electrical submersible pump) in the well, close to the methane hydrate reservoir.

An object of the present invention is to provide a solution for production of methane from a subsea methane hydrate formation in an efficient manner, preferably both with respect to time and costs.

THE INVENTION

According to the invention, there is provided a methane production assembly comprising a subsea well extending from the seabed to a methane hydrate formation. A well casing extends into the subsea well. The assembly has a subsea well control assembly, a submersible pump in fluid communication with the methane hydrate formation, and a methane-water separator having a water outlet and a methane outlet. According to the invention, the submersible pump is arranged above the subsea well.

Advantageously, a well control valve is part of the well control assembly.

In some embodiments, the methane production assembly may comprise a riser extending from a surface installation down to the well control assembly. Such a surface installation may be a floating surface facility, such as a ship, or an installation supported by the seabed.

In such embodiments, comprising a riser, the submersible pump may be arranged external to the well control assembly and the riser.

Alternatively, the submersible pump can be integrated with the well control assembly or with a disconnection apparatus.

Also, with embodiments where the methane production assembly comprises a riser, the methane-water separator can be integrated with a riser joint. Preferably, the separator would then be integrated with the lowermost or one of the lower riser joints.

In some embodiments, the methane-water separator can be arranged downstream of the well control assembly (i.e. the well control assembly being positioned between the separator and the well). Moreover, the submersible pump can connect to the water outlet. A flowline, which is in fluid communication with the methane outlet, can extend to shore.

With such a solution, one does not need a surface installation or a riser string during the production phase.

The well control assembly typically has a bore with a well control valve. In some embodiments, the bore is in fluid communication with a well space confined by the inwardly facing wall of the casing. Thus, in such embodiments, one does not need a production tubing extending into the well. Dissolved methane is conducted up through the well inside and in contact with the casing wall.

DETAILED DESCRIPTION

While the present invention has been discussed in general terms above, some detailed and non-limiting examples of embodiment will be presented in the following with reference to the drawings, in which FIG. 1 is a schematic illustration of a methane production assembly according to the prior art;

Figure 1:
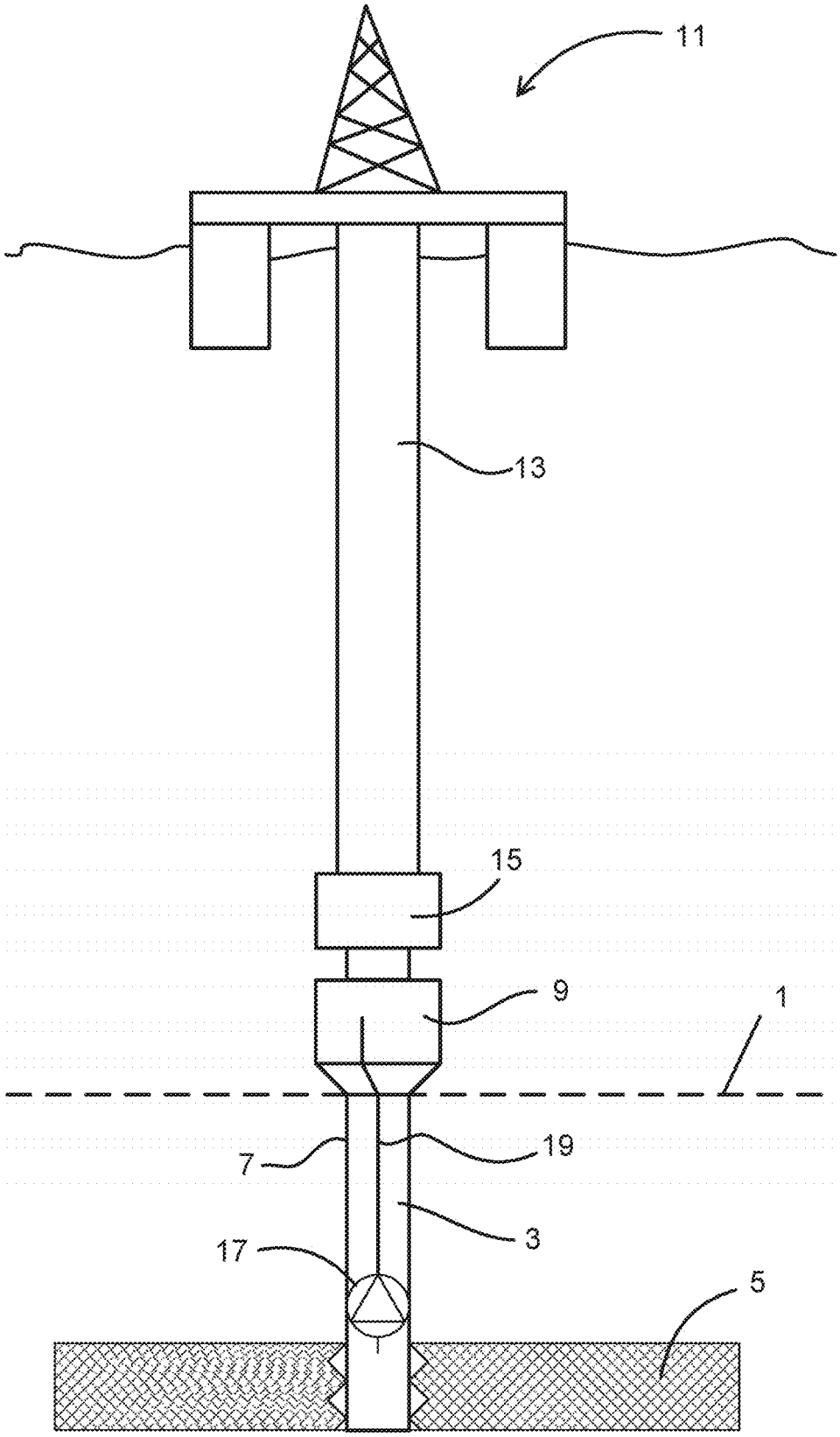

FIG. 1 depicts a methane production assembly according to a prior art solution. Down from the seabed 1, a subsea well 3 extends to a methane hydrate formation 5 below the seabed. A well casing 7 is arranged in the well 3.

At the wellhead, on top of the well 3, a well control assembly 9 is provided. From a surface installation 11, a riser string 13 extends down to the well control assembly 9. In this shown prior art solution, there is also arranged a disconnection apparatus 15 between the riser string 13 and the well control assembly 9.

The sea depth in the shown solution can for instance be about 1000 m. Thus, a pressure of about 100 bar will exist at the seabed. Moreover, with a water column inside the riser string 13 and the casing 7, a pressure of about 130 bar may exist at the lower portion of the casing 7 (i.e. at the position of the methane hydrate formation).

Down in the well 3 there is arranged an ESP (electrical submersible pump) 17 which is configured to pump water upwards through a water conduit 19 arranged in the well 3.

When the ESP 17 removes water from the water column (lowering the height of the column), the pressure is lowered and methane hydrate can dissolve into water and methane.

Figure 2:
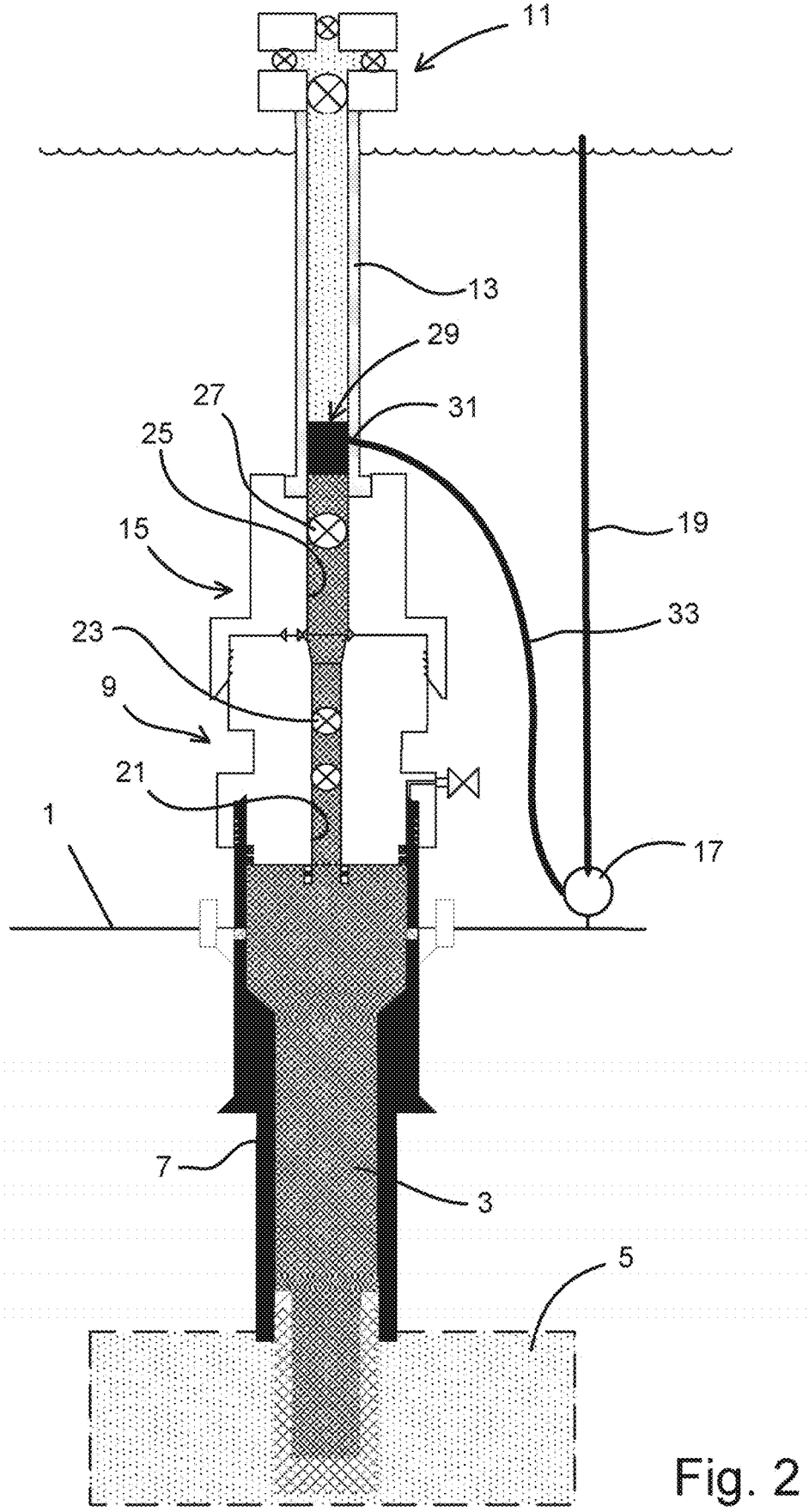
FIG. 2 is a schematic illustration of a methane production assembly according to the present invention.

FIG. 2 depicts an embodiment of the present invention with a schematic side view, similar to the view of FIG. 1. Components that are identical or similar to the ones referred to in FIG. 1, have been given the same reference numbers. In this embodiment according to the invention, shown in FIG. 2, the well control assembly 9 has a bore 21 provided with two well control valves 23. The disconnection apparatus 15 also has a bore 25 with a bore valve 27. If the riser string 13 is disconnected from the well control assembly 9, the bore valve of the disconnection apparatus 15 will retain the fluid in the riser string 13, which typically will be methane. In such a scenario, the well control valves 23 will also close.

In the embodiment shown in FIG. 2, a methane-water separator 29 is arranged above, i.e. downstream of the well control assembly 9. In this embodiment, it is also arranged downstream of the disconnection apparatus 15. The methane-water separator 29 has a water outlet 31, which connects to a pump hose 33. The pump hose 33 connects to a submersible pump 17, which in this embodiment is positioned separately from the well stack, i.e. separate from the well control assembly 9, the disconnection apparatus 15 and the riser string 13. A water conduit 19 extends from the submersible pump 17 and up to the surface installation 11. In the illustration of FIG. 2, the surface installation is represented merely in form of a surface flow tree. The surface flow tree will typically be installed on a floating vessel or the like.

Figure 3:
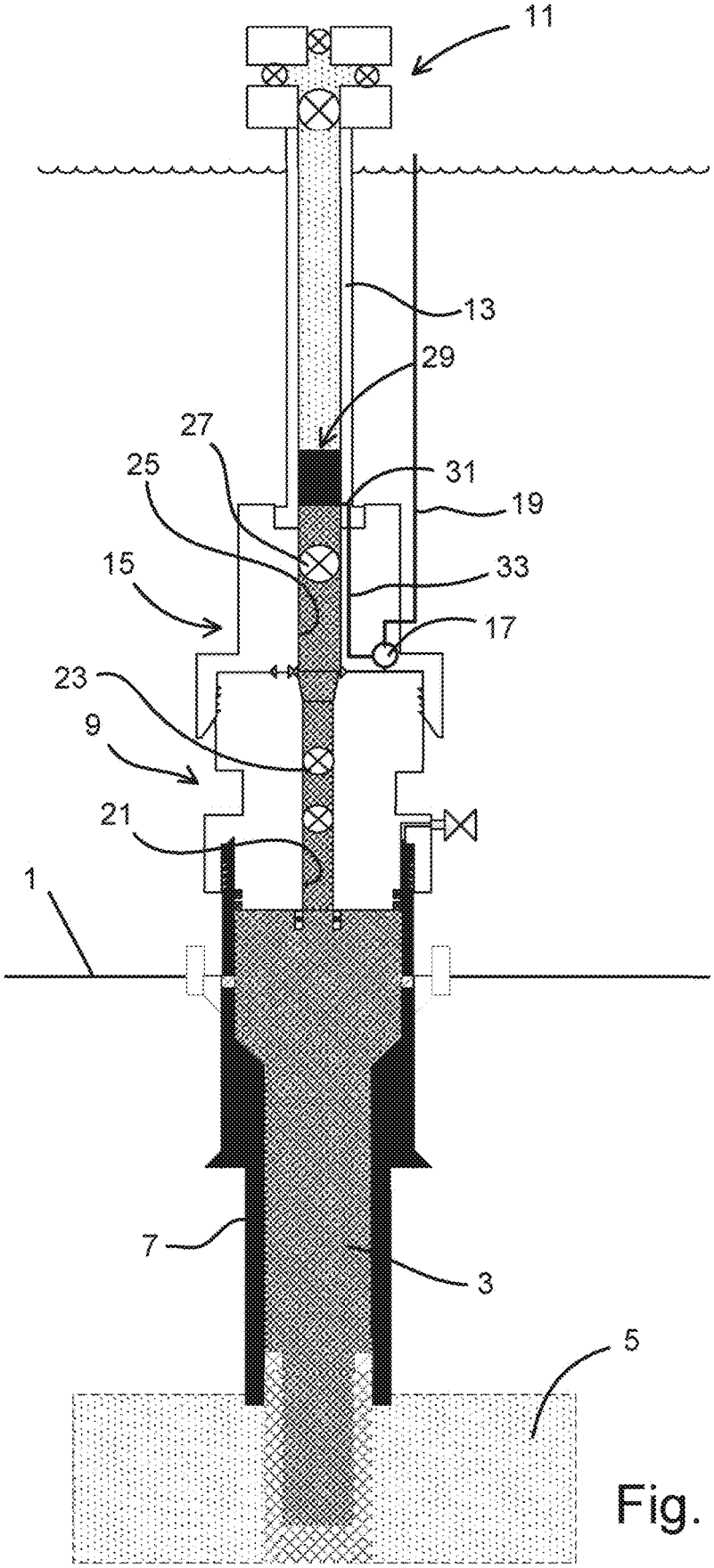
FIG. 3 is a schematic illustration of another embodiment according to the invention.

FIG. 3 depicts an embodiment which is similar to the embodiment shown in FIG. 2. However, in the embodiment shown in FIG. 3, the pump 17 is integrated with the disconnection apparatus 15.

In another embodiment, not shown in the figures, the pump 17 could be integrated with the well control assembly 9. Such an embodiment could be without the disconnection apparatus 15.

Figure 4:
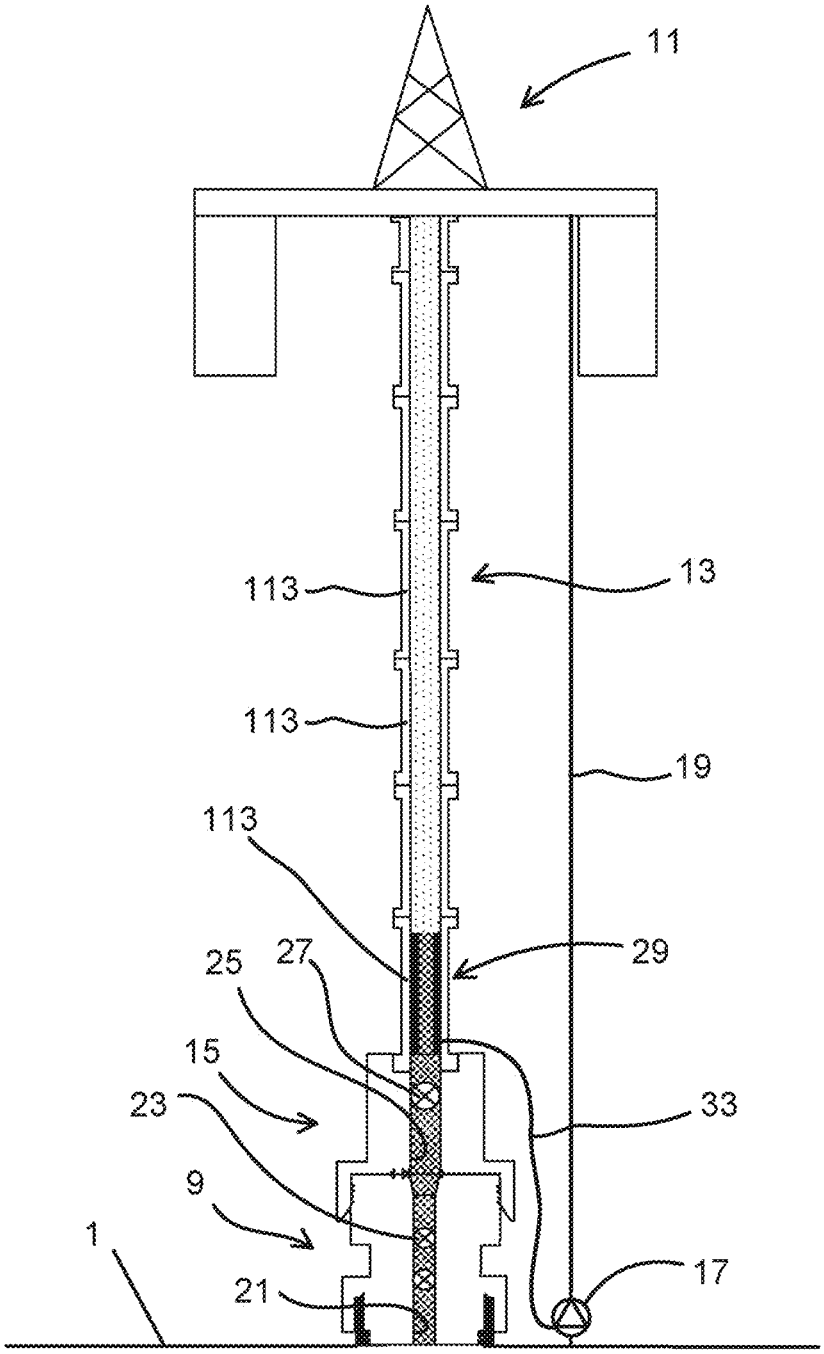
FIG. 4 is a schematic illustration of yet an embodiment according to the invention.

In the embodiment shown in FIG. 4, the separator 29 is integrated with one of the riser joints 113 which together with additional riser joints 113 form the riser string 13. In the shown embodiment, the methane-water separator 29 is integrated within the riser joint 113 that connects to the disconnection apparatus 15. In an embodiment without the disconnection apparatus, the riser joint 113 with the separator 29 could connect to the well control assembly 9. The illustration in FIG. 4 is shown without the well, which is below the well control assembly 9.

In the embodiments discussed with reference to FIG. 2, FIG. 3 and FIG. 4, the produced water can be pumped up to the surface installation 11 through the water conduit 19. The water conduit 19 may be attached to the riser string 13.

Figure 5:
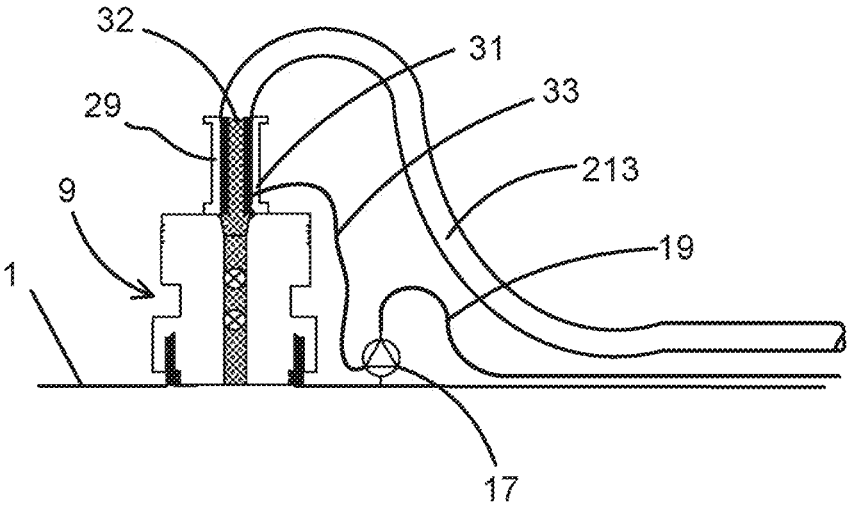
FIG. 5 is a schematic illustration of another embodiment of the invention.

Yet another embodiment is shown in FIG. 5. In this embodiment, there is no surface installation connected to the well control assembly 9. Instead, the produced methane is flown to an onshore receiving facility (not shown) through a flowline 213. The flowline 213 connects to the methane outlet 32 of the separator 29. Moreover, the submersible pump 17 connects to the water outlet 31 of the separator 29. The produced water, which is dissolved from the methane hydrate, is pumped onshore, such as to the same onshore receiving facility that receives the methane.

Figure 6:
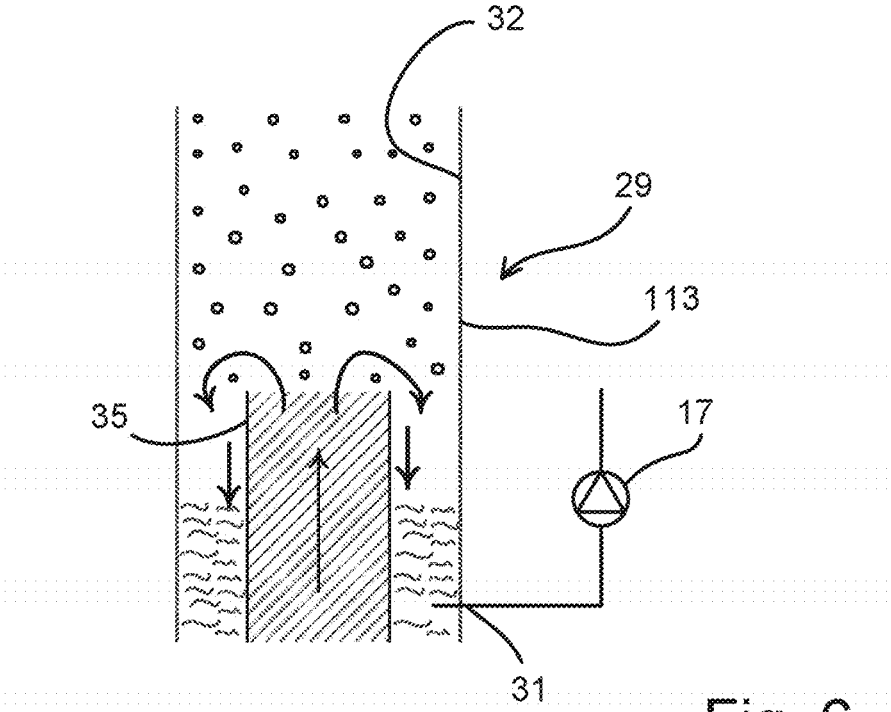
FIG. 6 is a schematic illustration of a methane-water separator.

FIG. 6 schematically depicts a methane-water separator 29. In one embodiment, as the embodiment discussed above with reference to FIG. 4, the separator 29 can be integrated with a lower part of the riser string 13. Thus, the embodiment shown in FIG. 6 may correspond to the embodiment discussed with reference to FIG. 4.

The separator 29 has a source pipe 35 which is in fluid communication with the methane hydrate formation 5. The source pipe 35 may connect to the formation 5 via a production tubing (not shown) extending into the well 3. However, one may also have solutions where no production tubing is used. In such an embodiment, the source pipe 35 may simply connect to the upper portion of the disconnection apparatus 15 or the upper portion of the well control assembly 9, for instance.

In the shown embodiment, the upper end of the source pipe 35 is arranged within an outer pipe, which may be the lower riser joint 113 of the riser string 13.

At a lower portion of the separator 29, a water outlet 31 is in fluid communication with an ESP 17.

If the riser string 13 contains a high water column, a significant pressure may exist at the methane hydrate formation 5. However, as the pump 17 pumps water out from the separator 29, the height of the water column in the riser string 13 will decrease. Eventually, the column height is sufficiently low so that a sufficiently low pressure exists at the formation 5. Provided that the temperature is high enough, typically at least about 0° C., methane hydrate will dissolve into water and methane gas. A mixture of water and gas will flow up through the source pipe 35. Due to gravity, water will accumulate at the lower portion of the outer pipe 113, outside the source pipe 35, while methane gas will raise upwards through the riser string 13 (or to the flowline 213, as shown in FIG. 5)

As the skilled person will appreciate, the vertical height of the water column (or a column containing a mix of methane and water) above the formation will govern the pressure in the area of the formation where the dissolving takes place. Moreover, the boundary between conditions where methane hydrate will and will not dissolve, extends along a curve which is a function of pressure and temperature. For instance, at about 0° C., the pressure must be less than about 28 bar. If the temperature is raised however, for instance to 10° C., the hydrate will dissolve even at about 65 bar (corresponding to about 650 meter water column). Consequently, the height between the position at which the pump 17 may remove water and the position of the area where the dissolving takes place needs to be within a height suitable for providing the dissolving process.

To elevate the temperature in the formation 5, heaters (not shown) may be arranged in the well.

The submersible pump 17 may be of any appropriate type, such as for instance an ESP (electrical submersible pump) or a HSP (hydraulic submersible pump).

Various details and technical features have been discussed above with reference to different embodiments. It should be noted that although some features have been related to specific embodiments, such features may be present also for other embodiments, and be isolated from other features of the embodiment with which the features were disclosed.

The invention claimed is:

1. A methane production assembly comprising:

a subsea well extending from the seabed to a methane hydrate formation;

a well casing extending into the subsea well;

a subsea well control assembly;

a submersible pump in fluid communication with the methane hydrate formation;

a methane-water separator having a water outlet and a methane outlet;

wherein the submersible pump is arranged above the subsea well;

a riser extending from a surface installation down to the subsea well control assembly; and wherein the methane-water separator is integrated with a riser joint.

2. The methane production assembly according to claim 1, wherein the submersible pump is arranged external to the subsea well control assembly and the riser.

3. The methane production assembly according to claim 1, wherein the submersible pump is integrated with the subsea well control assembly or with a disconnection apparatus.

4. The methane production assembly according to claim 1, wherein the methane-water separator is arranged downstream of the subsea well control assembly, wherein the submersible pump connects to the water outlet and wherein a flowline extending to shore is in fluid communication with the methane outlet.

5. The methane production assembly according to claim 1, wherein the subsea well control assembly has a bore with a well control valve, and wherein the bore is in fluid communication with a well space confined by the inwardly facing wall of the casing.

* * * * *